United States Patent [19]

van der Heijde

[11] 4,039,988

[45] Aug. 2, 1977

[54] DEFLECTION COIL HAVING SECTIONS WITH MINIMUM WINDING DENSITY PORTIONS AND SPACES

[75] Inventor: Martin Clemens van der Heijde, Eindhoven, Netherlands

[73] Assignee: U.S. Philips Corporation, New York, N.Y.

[21] Appl. No.: 683,722

[22] Filed: May 6, 1976

Related U.S. Application Data

[60] Continuation of Ser. No. 381,681, July 23, 1973, abandoned, which is a division of Ser. No. 198,833, Nov. 15, 1971.

[51] Int. Cl.² ..... H01F 5/00

[52] U.S. Cl. ..... 335/213; 335/210

[58] Field of Search ..... 335/210, 213; 336/225; 140/92.2; 242/7.12

[56] References Cited

U.S. PATENT DOCUMENTS

| | | | |
|---|---|---|---|
| 1,396,033 | 11/1921 | Francis | 140/92.2 |
| 2,167,379 | 7/1939 | Tolson | 336/225 X |
| 3,387,242 | 6/1968 | Corpew | 335/213 |
| 3,430,169 | 2/1969 | Gabor | 335/213 |
| 3,622,927 | 11/1971 | Washburn | 335/213 X |

*Primary Examiner*—George Harris

*Attorney, Agent, or Firm*—Frank R. Trifari; Henry I. Steckler

[57] ABSTRACT

A deflection coil for a cathode ray tube having spaced apart first and second coil sections with longitudinally extending winding elements, wherein said elements each define a first portion formed with a given winding density and a second end portion thereof being formed with a lesser winding density, said portions of given and lesser winding density of both coil sections being respectively arranged at corresponding ends of said coil.

3 Claims, 3 Drawing Figures

DEFLECTION COIL HAVING SECTIONS WITH MINIMUM WINDING DENSITY PORTIONS AND SPACES

CROSS REFERENCE

Figure 1:
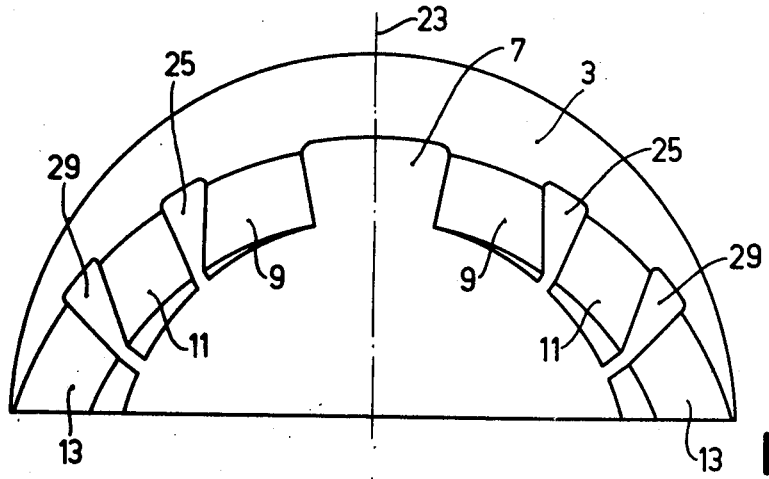

This application is a continuation of application Ser. No. 381,681, now abandoned filed July 23, 1973, which in turn is a division of application Ser. No. 198,833, filed Nov. 15, 1971, which is based on Netherlands application No. 7017341, filed Nov. 27, 1970. The priority of all said cases is hereby claimed.

The invention relates to a method of continuously winding saddle-shaped deflection coils for picture display tubes, in which the turns of the coil are distributed over a number of electrically series-arranged sections, each turn of a section encompassing the turns of the preceding sections.

Deflection coils for picture display tubes generally have the shape of saddle coils which accurately fit the neck and the adjoining, trumpet-shaped widening part of the picture display tube. One pair of these coils is used for the line deflection and one pair is used for the field deflection.

Particularly for picture display tubes having large deflection angles, especially for colour television, it is required that the distribution of the magnetic flux generated by the coils deviates only very little from the optimum distribution. The coils are wound to their desired shape on an automatic winding machine. In this case all kinds of circumstances which are difficult to control may cause small variations in the distribution of the turns on the coil so that it is found later on that a number of the coils wound on the machine does not meet these stringent requirements.

It has been proposed in German patent specification 1.274.249 to present a correction possibility by providing a multifilarly wound coil with tappings in some areas so that the coil is divided into a number of sections. The jointly wound wires of some sections are arranged in parallel and those of other sections are arranged in series. By varying the numbers of turns per section the distribution of the flux generated by the coil may be influenced.

A drawback of this method is that soldered joints have to be made afterwards on the tappings so as to achieve the correct arrangement of the different sections. This is time-consuming and hence expensive while in addition there is a risk of incorrect connections being made. Another drawback is that asymmetries occurring in a coil cannot be corrected or can only be corrected with difficulty in this manner.

An object of the present invention is to provide a method of winding in which the process can be rapidly adapted to modified circumstances without the coil having to undergo extra operations after winding.

To this end the invention is characterized in that the division in sections is established in that in some fixed areas adjoining turns are separated over a part of their length by open spaces whose locations within the coil are fixed, the number of turns in each section being variable and being adjusted during winding so as to influence the distribution of the magnetic flux generated by the coil in case of current passage.

In order to find out whether a change occurs in the distribution of the flux of the coils coming from the winding machine, from time to time a coil may be tested. Depending on the result of these samples the number of turns of each section is varied. The number of coils to be tested in proportion to the total production of the machine depends on the rate by which variations occur during the process and on the deviations allowed. Optionally, measuring and readjusting may be automated.

The open spaces on the boundary between two sections may be formed in a simple manner in that along each boundary, after the provision of the number of turns desired for the first of the two sections, a pin which is approximately at right angles to the plane of the turns is inserted in at least one area into the winding space whereafter the next section is wound around these pins.

It may be noted that winding of a deflection coil consisting of different sections with the aid of pins is know per se, for example, from U.S. Pat. No. 2.167.379. In that case, however, flat coils are concerned which are bent to a cylindrical shape at a later stage while in addition a number of separate concentrical coils are wound which are subsequently connected in series. The said U.S. patent specification does not mention anything about readjusting the process by adapting the number of turns per section.

Figure 2:
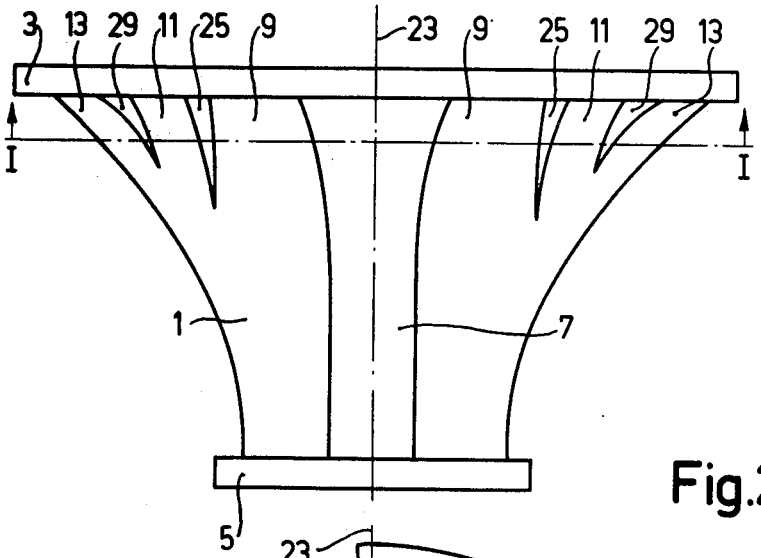
Figure 3:
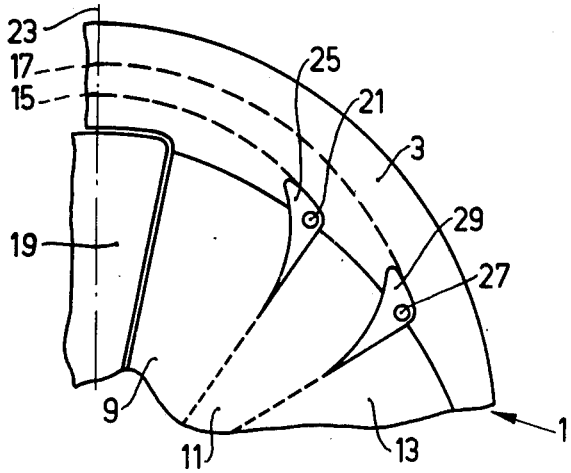

In order that the invention may be readily carried into effect, some embodiments thereof will now be described in detail by way of example with reference to the accompanying diagrammatic drawing in which:

FIGS. 1 and 2 show a deflection coil according to the invention in a cross-sectional view and a plan view and FIG. 3 shows a detail of the coil of FIG. 1 on a larger scale in a rear view during winding.

The saddle coil shown in FIGS. 1 and 2 consists of a central section 1, a front coil end 3 and a rear coil end 5. The central section 1 has a trumpetshaped widening and adjoins the surface of a picture display tube (not shown) whose gun is located behind the rear coil end 5 and whose picture screen is located in front of the front coil end 3. The conductors comprising the turns of the coil extend in the central section 1 approximately from the rear coil end to the front coil end. The magnetic field which is generated by the central section 1 of the coil provides the most important contribution to the deflection of the electron beam generated in the tube. The conductors in the coil ends 3 and 5 are approximately at right angles to the conductors in the central section 1, thus from the left to the right in FIG. 2. The coil ends 3 and 5 are bent away from the surface of the tube so that the magnetic field generated in the coil ends exerts only little influence on the electron beam.

A window 7 is provided in the centre of the central section 1. As is shown in the cross-section in FIG. 1 the thickness of the coil increases tangentially as from this window. The purpose thereof is to roughly distribute the magnetic flux generated by the coil in the desired manner.

In order to be able to influence this flux distribution also during winding, the turns of the coil are distributed over a number of sections. FIG. 3 shows how this distribution during winding is established. The Figure is a rear view of a portion of the front coil end 3 with the adjoining part of the central section 1. The coil consists of three sections 9, 11 and 13 the mutual boundaries 15 and 17 of which are denoted by broken lines. During winding the inner section 9 is wound first, for example, around a mandril 19. As soon as the number of turns required for section 9 is obtained, a pin 21 located substantially at right angles to the plane of the turns is inserted into the winding space at an area located on the boundary 15. A second pin 21 (not shown) is located in reverse to the symmetry plane 23 of the coil located at right angles to the plane of the drawing.

The first turn of the next section 11 is provided around the pin 21 so that open spaces 25 are created in the vicinity of these pins, which spaces are bounded by the outer turns of section 9 and the inner turns of section 11. The turns of sections 9 and 11 adjoin each other at some distance from the pins 21 so adjoin each pther at some distance from the pins 21 so that the boundary 15 is invisible or hardly visible at that area.

The second pin 21 may be inserted simultaneously with the first pin into the winding space so that the boundary 15 on either side of the symmetry plane 23 varies symmetrically, but alternatively a number of turns can be provided after one of the pins 21 has been inserted into the winding space, whereafter the second pin 21 is inserted. In this case the coil becomes asymmetrical so that asymmetries created in a different manner may be compensated for. Then, as it were, a small extra section is added between the two sections 9 and 11, which extra section adjoins section 9 in one half of the coil and section 11 in the other half.

After the required number of turns of the section 11 is reached, two pins 27 which are substantially at right angles to the turn are inserted in an analogous manner into the winding space around which pins the first turn of section 13 is provided. Then again open spaces 29 are created between the outer turns of section 11 and the inner turns of section 13.

In the embodiment described the open spaces 25 and 29 are present on the front side of the central section 1 near the front coil end 3. The open spaces may of course alternatively be provided at other areas, for example, near the rear coil end 5. Likewise more than two open spaces per section boundary may be provided, for example, two spaces near the front coil end and two near the rear coil end.

The area of the open spaces shown in the embodiment is, however, particularly favourable because the central section 1 of the coil fans out in the forward direction so that the density of the turns near the front coil end 3 is considerably smaller than that near the rear coil end 5. The result thereof is that small local variations in, for example, the distribution of the turns on the front side of the central section 1 exert a much greater influence on the distribution of the magnetic flux than the same variations do on the rear side of the central section. Therefore it is important to have a correction possibility for the front side of the central section 1, which possibility consists in the variation of the number of turns in each of the three sections 9, 11 and 13.

What is claimed is:

1. A saddle shaped television deflection coil for a cathode ray display tube, said coil comprising a first coil section comprising longitudinally extending winding elements forming a portion of a tubular coil assembly, a first portion of said winding elements being formed with a given winding density and a second end portion of said elements being formed with a lesser winding density; a second coil section having longitudinally extending elements arranged in adjacent relationship with the elements of said first section and having a first end portion of a given winding density and a second end portion being formed with a lesser winding density than said first end portion of said second section, said portions of lesser winding density being arranged at the same end of said coil assembly and being spaced apart at the portion of lesser density and said portion of said given winding density being arranged at the same end of said coil and being contiguous with each other; and means for generating a selected magnetic field upon current being applied to said sections comprising said sections having a selected number of turns.

2. A coil as claimed in claim 1 wherein said sections have a common winding plane.

3. A coil as claimed in claim 2 wherein said coil has a symmetry plane and further comprising means for compensating for asymmetries in said coil.

* * * * *